US005875989A

United States Patent [19]

Alexander, III

[11] Patent Number: 5,875,989

[45] Date of Patent: Mar. 2, 1999

[54] START UP APPARATUS AND METHOD FOR WINDING A WEB ROLL

[76] Inventor: William J. Alexander, III, P.O. Box 848, Mauldin, S.C. 29662

[21] Appl. No.: 725,484

[22] Filed: Oct. 4, 1996

[51] Int. Cl.[6] ..... B65H 19/22; B65H 35/08; B65H 19/28; B65H 18/14

[52] U.S. Cl. ..... 242/533; 242/526; 242/532; 242/542

[58] Field of Search ..... 242/533, 533.3, 242/527, 532, 532.3, 542, 542.3, 526

[56] References Cited

U.S. PATENT DOCUMENTS 3,817,467 6/1974 Dambroth ..... 242/527.2

5,022,597 6/1991 Morizzo ..... 242/533.1 X

*Primary Examiner*—John Q. Nguyen

*Attorney, Agent, or Firm*—Ralph Bailey, P.A.

[57] ABSTRACT

Apparatus and method for winding a web roll on a surface winder for automatically starting up an end of a web for winding utilizes an elongated cradle (A) into which a web end severed by a cutting apparatus (B) after a full web roll is doffed falls into a flexible cradle a free end of which is raised responsive to lifting apparatus (D) causing a severed end of an incoming web to be started on a new roll core which has been positioned by a dispenser (C) over the severed end of the web, and wherein further raising of the cradle places the new roll core with the severed end upon the surface winder.

12 Claims, 4 Drawing Sheets

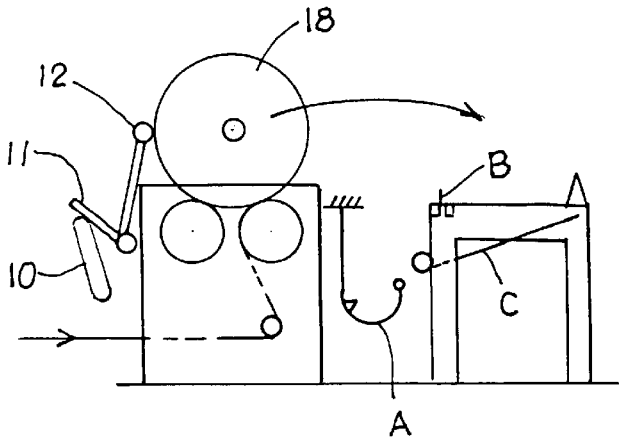
Fig. 2.
Fig. 3.
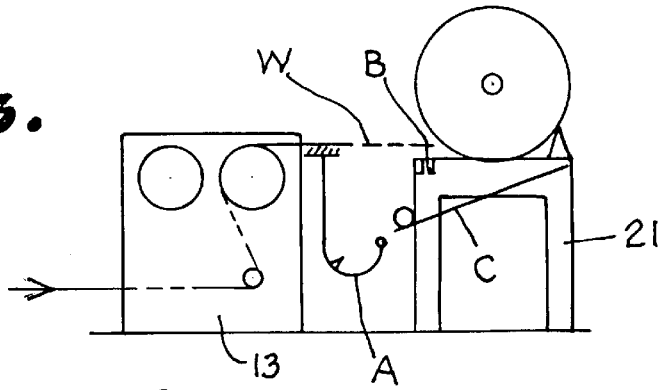
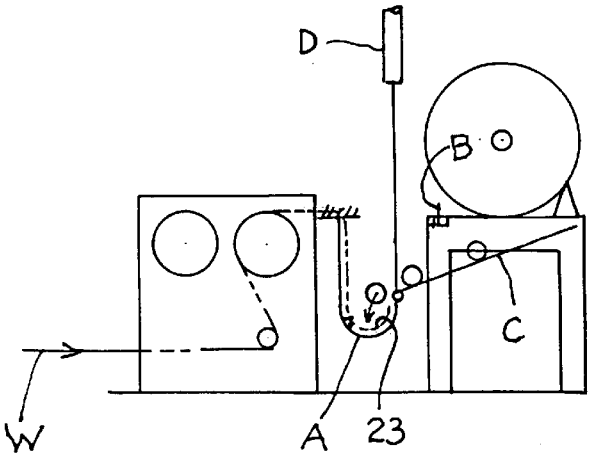
Fig. 4.
Fig. 5.
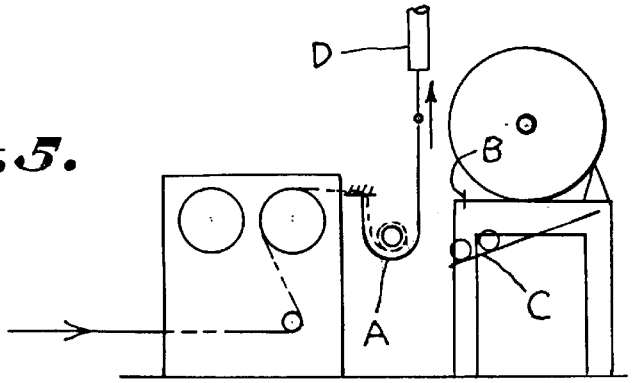

START UP APPARATUS AND METHOD FOR WINDING A WEB ROLL

BACKGROUND OF THE INVENTION

This invention relates to apparatus and method utilizing an automated mechanism for starting a web end severed after doffing a full web roll being fed for winding about a new roll core.

It has been the practice when doffing web rolls to cause them to be received upon a support positioned laterally of the winder and the like from which the full roll may be moved by a conveyor or a cart for packaging or to a subsequent process. A new roll core is then manually or semi-automatically placed upon the rolls of a surface winder for starting up the severed end of the web upon the web roll for starting a subsequent winding operation.

For example, U.S. Pat. No. 4,203,563 illustrates a manual loom takeup cloth roll doffer which describes doffing large cloth rolls upon laterally positioned carts for carrying the cloth rolls for subsequent finishing operations.

A further example of a doffing apparatus wherein roll cores are doffed automatically from a cloth dewinder is illustrated in U.S. Pat. No. 5,209,418, the disclosure of which is incorporated herein and made a part hereof by reference.

U.S. Pat. No. 3,817,467 illustrates an apparatus for continuously winding webs having an automatic start up apparatus which includes an upwardly moving jet of air for starting a severed end of the web about a new takeup spool. U.S. Pat. No. 4,422,586 illustrates a method and apparatus for doffing a web roll on a winding machine wherein the severed end of the web is started around a new core by means of a pressure sensitive adhesive strip run the length of the new core. While the apparatus and method of the present invention is not dependent upon the use of an adhesive strip such may be utilized as an aid in starting the severed end upon a new core. U.S. Pat. No. 5,022,597 illustrates a batcher type winder specially adapted for winding textile fabrics which utilizes air jets for starting the severed end of the fabric about a new core roll.

SUMMARY OF THE INVENTION

Accordingly, it is an important object of the invention to provide a web roll doffing apparatus having suitable means for severing the web from a doffed web roll to cause the severed end of the web to start up about a new core roll to commence a subsequent winding operation automatically.

Another object of the invention is to provide an apparatus and method wherein means are provided for severing the web from a doffed web roll and providing automatic means for starting up a subsequent winding operation on a new roll core utilizing a cradle formed in a flexible support member fastened on one end to the winder and having a free end for lifting to start the web on a roll in the cradle.

It has been found that by utilizing an elongated cradle for receiving the severed end of the cloth being fed into a winder and the like after doffing that a new roll core may be positioned on top of the cloth and by thereafter raising the cradle the roll core is caused to turn, and the cloth to begin building convolutions upon the roll core thus effecting an automatic start up.

Further, a cutting apparatus positioned adjacent a receiving support for the doffed core roll after doffing may automatically sever an incoming cloth or other web so as to provide an elongated end for utilization by a roll core for building start up convolutions thereon to facilitate automatic cloth handling means for winding, doffing and further processing.

By causing a cradle which has received a severed end of a cloth web after takeup to be raised for starting about a turning roll core positioned over the severed end of the cloth, an automatic start up may be achieved. By further raising the cradle and the roll core, the roll core may be automatically positioned upon the rolls of a surface winder or batcher.

Thus, a method is provided for automatically winding a web about a core roll for start up of a new winding operation automating the procedure for starting the material about the core.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 2 is a schematic end elevation further illustrating the use of a flexible cradle for facilitating automatic start up in accordance with the present invention;

FIG. 3 is a schematic end elevation similar to FIG. 2 illustrating a cutting operation following doffing forming a severed end of incoming cloth;

FIG. 4 is another end elevation schematically illustrating the positioning of a core roll on the severed end of cloth;

FIG. 5 is a schematic end elevation illustrating the raising of a free edge of the cradle causing an automatic start up;

DESCRIPTION OF A PREFERRED EMBODIMENT

The drawings illustrate apparatus and method for doffing a web roll from a surface winder onto a receiving support positioned forwardly thereof in spaced relation as well as apparatus and method for positioning a new roll core for start up on the surface winder. An elongated flexible cradle A has a connection adjacent a rear edge on a doffing side of the surface winder. Cutting apparatus B adjacent the receiving device automatically severs the web after doffing of the web roll causing a web end portion of the web roll to fall into the elongated cradle. A roll dispenser C positions a roll core in the cradle on the web end portion. Lifting apparatus D raises a free end of the cradle causing the roll core to turn engaging the free end portion of the web for start up. Further, raising of the cradle places the roll core with the start up end of the web on the surface winder.

Referring more particularly to FIG. 2, a doffing mechanism is schematically illustrated which may be of the type illustrated in U.S. Pat. No. 4,203,563. If desired, the device shown in the patent may be automated by providing a cylinder 10 for operating through suitable linkage 11 the doffing roll 12 for rolling the web roll upon the receiving support.

Figure 1:
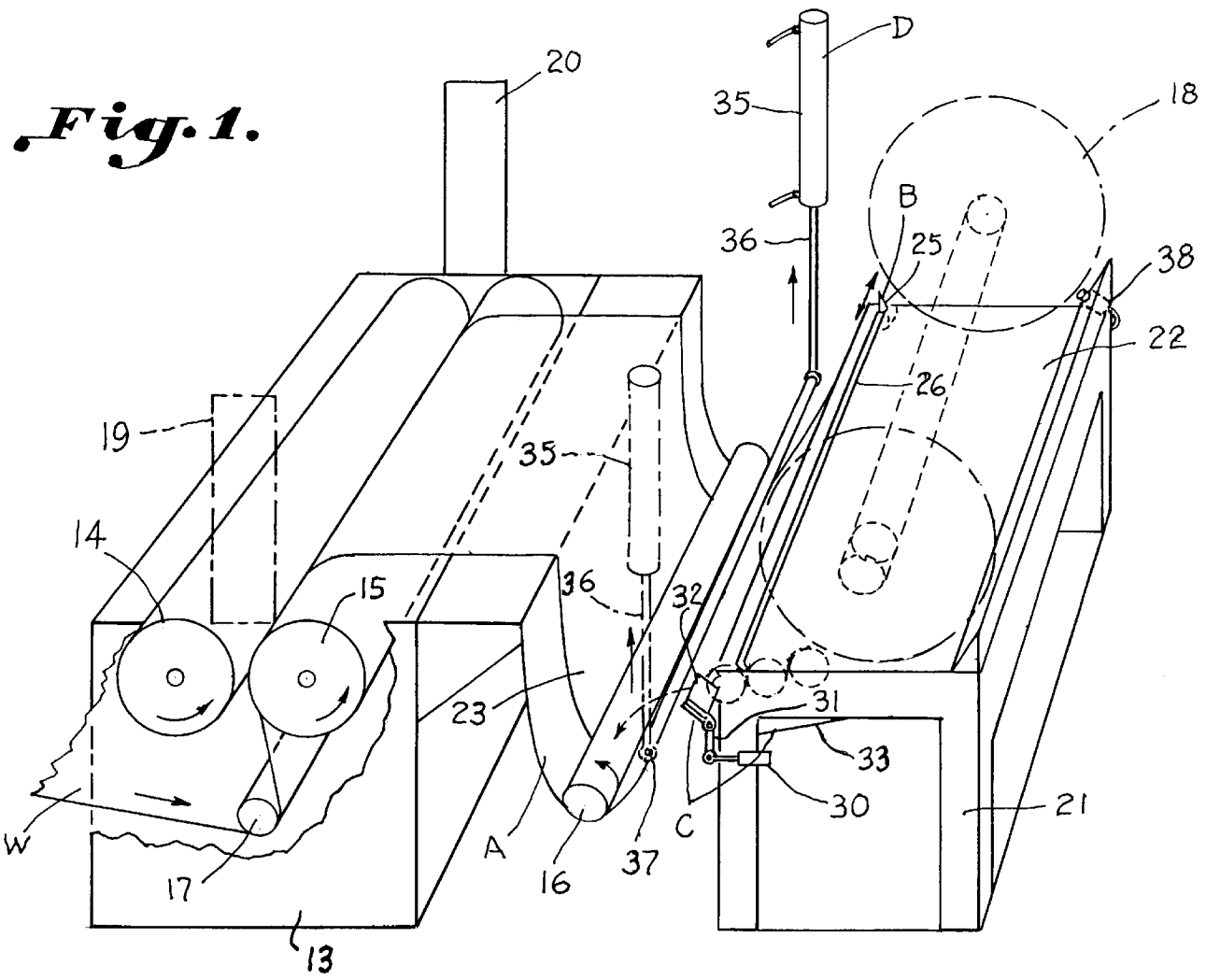
FIG. 1 is a perspective view illustrating a cloth batcher with automatic start up apparatus for initiating a new winding operation constructed in accordance with the present invention.

Referring particularly to FIG. 1, a more detailed illustration of an apparatus constructed in accordance with the invention includes a batcher having a frame 13 carrying driven support rolls 14 and 15 for surface winding a new core roll 16 during a buildup. A web W which is illustrated as cloth in FIG. 1 is being fed about a direction roll 17 between the surface support rolls 14 and 15 for winding on a roll core 16 when it has been positioned thereon after start up for carrying out a winding operation. The roll which will be wound thereon and which is illustrated at 18 in FIG. 2 is positioned between spaced standards 19 and 20 for guiding the web roll during the winding operation. The web W is illustrated in FIG. 3 as extending between the batcher frame 13 and a receiving support including a frame 21. The receiving support has an upper support surface 22 for receiving the cloth roll illustrated at 18 in broken lines in FIG. 1.

FIG. 4 illustrates a severed end 23 of the cloth W which has fallen down into the cradle subsequent to a cutting or severing operation by the cutting apparatus B. FIG. 1 illustrates the apparatus in position following a severing operation and after feeding of a roll core over the severed end 23 preparatory to raising the cradle as illustrated in FIG. 5.

The cutting operation is preferably carried out utilizing a vertical blade 25 which is carried in a tract 26 which may be moved along the tract traversing across a receiving edge of the receiving device. The cutting apparatus may include an automatically operated reel having an extensible, retractable member or other suitable mechanism (not shown) for driving the blade 25 across the tract 26 severing the free end of the cloth 23.

Figure 6:
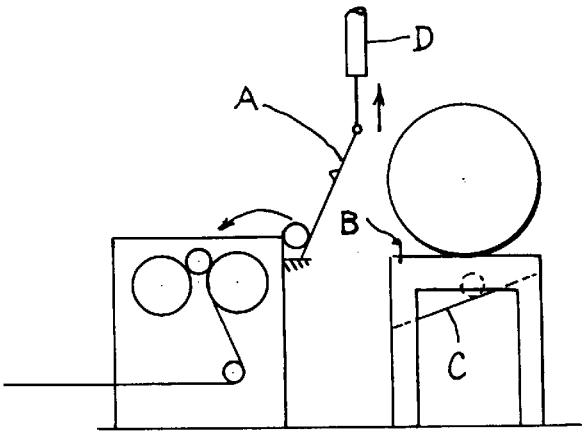
FIG. 6 illustrates a further raising of the cradle automatically feeding the core roll to a position between the support rolls of a surface winder for commencing the build of a new web roll.

FIG. 1 also illustrates dispensing apparatus C for positioning the roll core in the cradle on the web end portion 23 as including a solenoid 30 for actuating suitable linkage mechanism 31 for lowering a retaining member 32. The dispenser C further includes an inclined chute 33 for releasing a roll core one at a time into the cradle A. The cradle A should preferably be constructed of suitable flexible material. It will be observed that lifting apparatus D for raising a free end of the cradle may include fluid operated cylinders 35 each having an extensible member 36 carried at each end of a bar 37 at a free end of the cradle. The bar 37 facilitates raising the free end of the cradle to positions illustrated in FIGS. 5 and 6. FIG. 1 illustrates a switch 38 for initiating the sequence of switching operations for actuating the cutting, raising and roll feeding hereof responsive to reception of the doffed web roll upon the receiving support.

Figure 7:
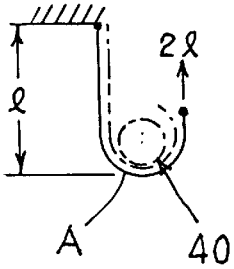
FIG. 7 is a schematic end elevational view illustrating a preferred apparatus for initial start up.
Figure 8:
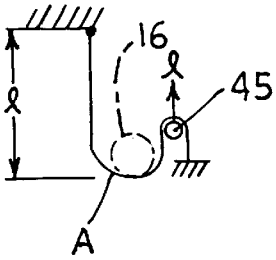
FIG. 8 is an alternate form of apparatus for initiation of an automatic start up in accordance with the invention.
Figure 9:
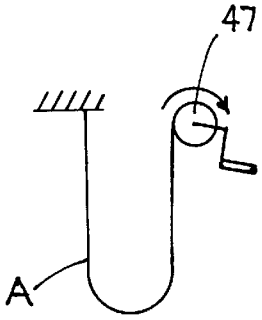
FIG. 9 is an end elevation illustrating another modified form of apparatus for initiating an automatic start up constructed in accordance with the present invention.

FIG. 7 schematically further illustrates the apparatus for initiating the automatic windup operation in accordance with the drawings described above. FIG. 8 illustrates a modified form of the invention wherein a bar 45 is raised for raising a cradle fixed opposite the winder adjacent a base of the support 21 so as to initiate turning of the roll core 16 with start up of the cloth winding thereon. FIG. 9 illustrates a further modified form of the automatic start up apparatus wherein an end of the cradle A is wound upon a driven roll 47.

Figure 10:
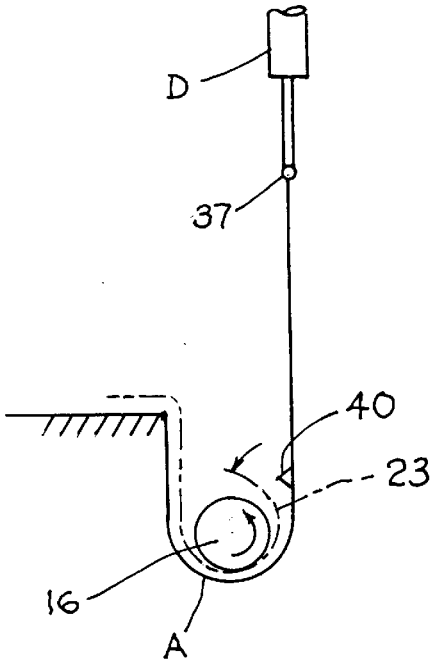
FIG. 10 is a schematic illustration, at an enlarged scale, further illustrating the operation of the apparatus constructed in accordance with a preferred embodiment of the invention in effecting an automatic start up.

FIG. 10 best illustrates the placing of the free end 23 of the severed cloth over the roll core 16. This is facilitated through the use of a transverse bar or strip 40 which extends across the cradle adjacent the free end thereof beneath the bar 37. The strip need not be tacky in order to flip the end of the severed material over the roll core 16 to start an automatic windup operation by exerting a momentary and transitory force upon the severed end as the bar passes the free end on its upward course.

Figure 11:
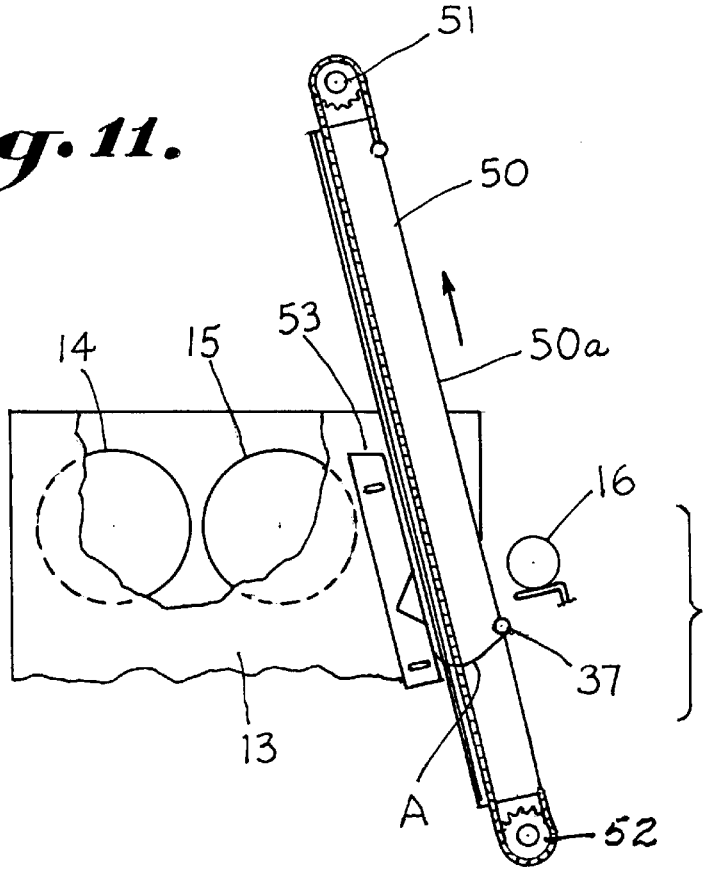
FIG. 11 is a schematic side elevation illustrating a modified form of the invention wherein spaced inclined chains are driven to raise a horizontal bar at a free end of a flexible cradle.

FIG. 11 illustrates a modified form of the invention wherein a pair of transversely spaced inclined chains 50 are driven by an upper sprocket 51. The chains are supported by a lower sprocket 52 and have an upward run 50*a* to which a bar 37 is attached. The free end of the cradle A is attached to the bar 37 and the other end of the cradle is attached as at 53 to the frame 13 of the winder. By turning the sprocket 51, the run of the chain 51*a* moves upwardly creating the cradle A, causing the new roll 16, which is dispensed therein over a severed end of the fabric, to turn on a start up winding a new web roll.

Figure 12:
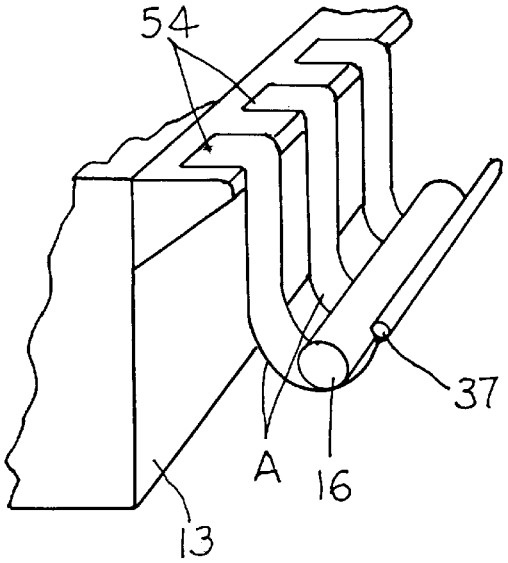
FIG. 12 is a perspective view illustrating a modified form of the invention wherein the flexible cradle member is made up of spaced longitudinal narrow fabric strips.

FIG. 12 illustrates a modified form of the invention wherein the cradle A is illustrated as being formed from a plurality of transversely strips or webbing 54 which are attached at one end to the frame 13 while the free end carries a bar 37.

Thus, the full web roll is doffed or unloaded from the winding device onto a stationary surface adjacent the winding device. The stationary surface may be that of an automatic guided vehicle, a conveyor, truck or holding table and the like. The fabric then remains intact through the process and attached to the roll. Underneath the fabric which bridges from the winding device to the stationary surface is a flexible inelastic material forming a cradle transversely along the fabric. The fabric is now cut and a severed end or flap falls by gravity into the cradle. A new roll core is fed into the cradle on top of the fabric. The end of the cradle closest to the winder is fixed on or closely adjacent the winder. The end closest to the stationary surface is attached to a device that will direct this end upwardly. As the free end of the cradle is directed upwardly, the core is caused to rotate with the fabric. When the end of the cradle has completed its vertical travel, the core has preferably been caused to rotate at least 360° so that sufficient fabric has been wrapped around the core to begin winding. The core then rolled onto the winder.

While a preferred embodiment of the invention has been described using specific terms, such description is for illustrative purposes only, and it is to be understood that changes and variations may be made without departing from the spirit or scope of the following claims.

What is claimed is:

1. Apparatus for doffing a full web roll from a surface winder having a pair of winder support rolls onto a receiving support spaced forwardly of the rolls and for positioning a web end and a roll core for start up on the surface winder rolls comprising:

a receiving support;

a doffer for moving said web roll from the winder support rolls onto said receiving support;

a elongated flexible cradle having a connection on one end to a side of said winder support rolls; said cradle positioned between said winder support rolls and said receiving support cutting apparatus adjacent said receiving support for severing said web after doffing of the web roll therefore forming a severed web end portion which is received into said elongated cradle;

a dispenser for positioning a roll core in said cradle and on said severed web and for engaging said web end; and apparatus for lifting a second end of the cradle and for causing said severed web end to wrap around the roll core.

2. The structure set forth in claim 1 wherein a web engaging member extends transversely across the length of said elongated cradle exerting a force upon said web end aiding in starting the winding of convolutions of the web upon the core roll.

3. The structure set forth in claim 1 wherein said second end of the cradle is the remote end of the cradle from the winder support rolls and wherein further lifting of the cradle moves the roll core over an adjacent support roll of the surface winder positioning same upon the surface winder for winding a web roll.

4. The structure set forth in claim 3 wherein said doffer includes power operated means moving said web roll over a support roll of the surface winder opposite an adjacent support roll.

5. The structure set forth in claim 4 wherein said apparatus for lifting the cradle includes linkage actuated subsequent to doffing of the web roll for lowering the cradle.

6. The structure set forth in claim 1 wherein the apparatus for lifting the cradle includes an elongated flexible support; and a bar extending along and connected to a free forward end of the flexible cradle remote from said one end.

7. The structure set forth in claim 6 wherein said flexible support is a web member.

8. The structure set forth in claim 6 wherein said apparatus for lifting the cradle includes a pair of fluid operated cylinders attached at respective ends of said bar.

9. The structure set forth in claim 6 including a pair of inclined spaced driven chains having a forward run carrying said bar therebetween.

10. The structure set forth in claim 1 wherein the cradle includes an elongated flexible support connected at a forward end adjacent a base of said receiving support; and a bar connected to a forward portion of said cradle raised by spaced fluid cylinders.

11. The structure set forth in claim 1 wherein said cradle is flexible having a forward end carried upon a driven rotating roll for raising the cradle.

12. The structure set forth in claim 1 wherein the cradle includes transversely spaced narrow longitudinal flexible members.

* * * * *